US005345649A

United States Patent [19]

Whitlow

[11] Patent Number: 5,345,649

[45] Date of Patent: Sep. 13, 1994

[54] FAN BRAKE FOR TEXTILE CLEANING MACHINE

[76] Inventor: William T. Whitlow, 4233 Waterbury Dr., Charlotte, N.C. 28209

[21] Appl. No.: 51,080

[22] Filed: Apr. 21, 1993

[51] Int. Cl.[5] ..... B08B 5/04

[52] U.S. Cl. ..... 15/312.1; 15/339; 15/412

[58] Field of Search ..... 15/312.1, 312.2, 339, 15/412

[56] References Cited

U.S. PATENT DOCUMENTS

| | | | |
|---|---|---|---|
| 2,901,881 | 9/1959 | Byrum | 15/312.1 X |
| 3,046,162 | 7/1962 | Black | 15/312.2 X |
| 3,437,520 | 4/1969 | Black | 15/312.1 X |
| 4,121,317 | 10/1978 | Sohler | 15/312.2 |
| 4,572,745 | 2/1986 | House | 15/312.2 X |

*Primary Examiner*—Chris K. Moore

*Attorney, Agent, or Firm*—W. Thad Adams, III

[57] ABSTRACT

A traveling, rail-mounted overhead cleaner for cleaning textile processing machines and adjacent floor areas. The cleaner includes a cleaner chassis, drive means for moving the cleaner along the rail, fan means for generating an air flow, conduit means cooperating with said fan means for applying the air flow to areas to be cleaned, a waste canister cooperating with said conduit means for receiving and retaining accumulated waste therein, an unloading station for unloading waste accumulated by the cleaner. An electrical circuit means is included for controlling the movement of the traveling cleaner around its cleaning circuit and to and from the unloading station. In combination with the above elements is the improvement which includes brake means for applying an external braking force to said fan means for bringing the fan means to a stop at a rapid rate.

5 Claims, 5 Drawing Sheets

FAN BRAKE FOR TEXTILE CLEANING MACHINE

TECHNICAL FIELD AND BACKGROUND OF THE INVENTION

This invention relates to a fan brake for a traveling textile cleaner, particularly a textile cleaning machine of the type disclosed in U.S. Pat. No. 4,697,298. In such a device, a traveling cleaner unit moves along an endless rail suspended over a textile machine to be cleaned. The traveling cleaner unit includes blower nozzles for directing cleaning air against parts of the textile machine, such as a loom or spinning frame, or the like, and vacuum nozzles to pick up waste and transport it to a waste canister. Periodically the waste canister must be emptied. The traveling cleaner is docked to a unloading station so that the contents of the waste canister can be unloaded. However, the blower fan exerts a strong downstream pull on the waste, holding it against a collection screen in the waste canister. Before the waste can be removed, the fan must be stopped so that the waste is no longer held against the collection screen. Only then can the waste be removed from the canister so that the cleaning unit can continue its travel along the rail.

In prior art applications, it may take as long as one minute for the fan motor to spin down from its operating speed to a sufficiently slow speed to permit the waste to be removed from the collection screen. This substantially slows the operation of the unit, and introduces what is, in effect, a substantial amount of dead, non-cleaning time into the cleaning system routine.

The invention claimed in this application provides a simple, inexpensive and non-wear promoting way of quickly bringing the blower fan to a stop so that the waste canister of the cleaning unit can be emptied at the unloading station.

SUMMARY OF THE INVENTION

Therefore, it is an object of the invention to provide a fan brake for a traveling textile cleaner.

It is another object of the invention to provide a fan brake for a traveling textile cleaner which is simple and efficient to operate.

It is another object of the invention to provide a fan brake for a traveling textile cleaner which has no wear-producing parts which require additional maintenance or part replacement.

These and other objects of the present invention are achieved in the preferred embodiments disclosed below by providing a traveling, rail-mounted overhead cleaner for cleaning textile processing machines and adjacent floor areas. The cleaner includes a cleaner chassis, drive means for moving the cleaner along the rail, fan means for generating an air flow, conduit means cooperating with the fan means for applying the air flow to areas to be cleaned, a waste canister cooperating with the conduit means for receiving and retaining accumulated waste therein, and an unloading station for unloading waste accumulated by the cleaner. An electrical circuit means is included for controlling the movement of the traveling cleaner around its cleaning circuit and to and from the unloading station.

In combination with the above elements is the improvement which includes brake means for applying an external braking force to the fan means for bringing the fan means to a stop at a rapid rate.

According to one preferred embodiment of the invention, the fan means comprises an alternating current fan motor, and a fan rotatably-mounted on the fan motor. The brake means includes electrical contactor means for removing alternating current from the fan motor windings.

According to another preferred embodiment of the invention, the brake means includes timing means for removing the direct current voltage from the fan motor winding after a predetermined time.

According to yet another preferred embodiment of the invention, the unloading station includes blower means for blowing air through the conduit means and waste canister to discharge the waste into the unloading station. The circuit means activates the fan upon removal of the direct current from the fan motor.

According to yet another preferred embodiment of the invention, the fan comprises a flat disk having fan blades formed in the axially-extending periphery thereof.

An embodiment of the method according to the invention comprises the steps of removing alternating current from windings of the motor when braking is desired and simultaneously applying a constant-state direct current voltage to a fan motor winding of the fan motor to thereby inductively retard rotation of the motor and thereby brake the fan.

According to one preferred embodiment of the invention, the method includes the step of removing the direct current voltage from the fan motor winding after a predetermined time.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
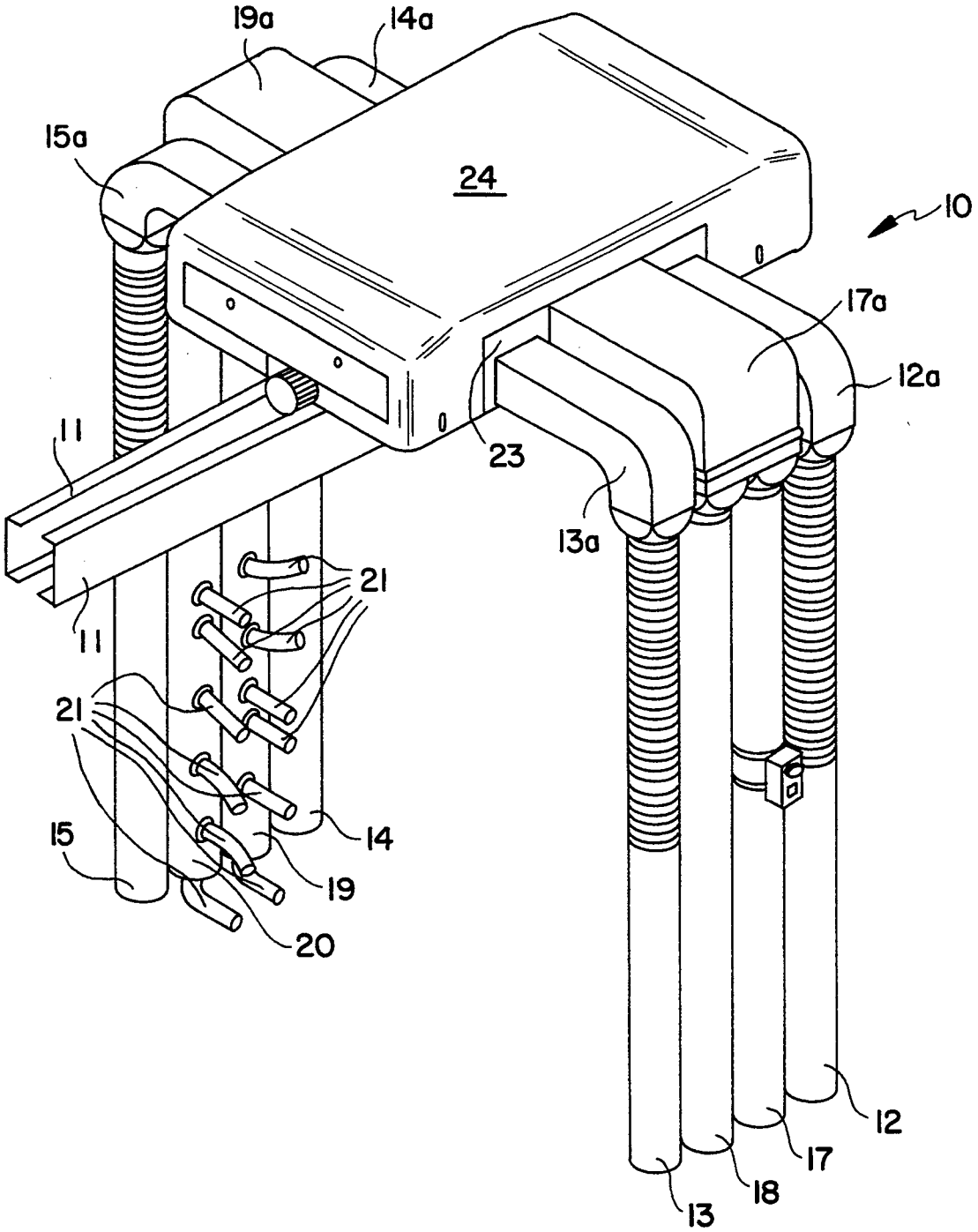
FIG. 1 is a perspective view of a traveling textile cleaner according to an embodiment of the present invention.

Referring now specifically to the drawings, a traveling cleaner according to the present invention is illustrated in FIG. 1 and shown generally at reference numeral 10. The traveling textile cleaner 10 is mounted for motorized movement along an overhead rail 11. Systems of the general type described may be configured to travel continuously in the same direction or to reverse direction and move back along a path just traversed in the opposite direction, depending on the rail arrangement. The traveling textile cleaner 10 includes two pairs of outboard vacuum legs 12,13 and 14,15 which are open at the bottom and which vacuum lint and other waste off of the floor. The traveling textile cleaner 10 also includes two pairs of inboard blower legs 17,18, and 19,20. The blower legs 17–20 are equipped with a series of nozzles 21 which communicate with the blower legs 17–20 and direct pressurized cleaning air against the textile machines as the traveling textile cleaner 10 passes by. The nozzles 21 are arranged by length, size and position to direct air against specific points on the machines. Of course, different sizes, numbers and positions of nozzles can be selected depending on the particular type of machine being cleaned.

The traveling textile cleaner 10 also includes a chassis 23 which is normally covered by a unit cover 24. Vacuum ducts **12*a*–15*a* and blower ducts 17*a* and 19*a* extend out from the chassis and interconnect with the vacuum legs 12–15 and blower legs 17–20**, respectively.

Figure 2:
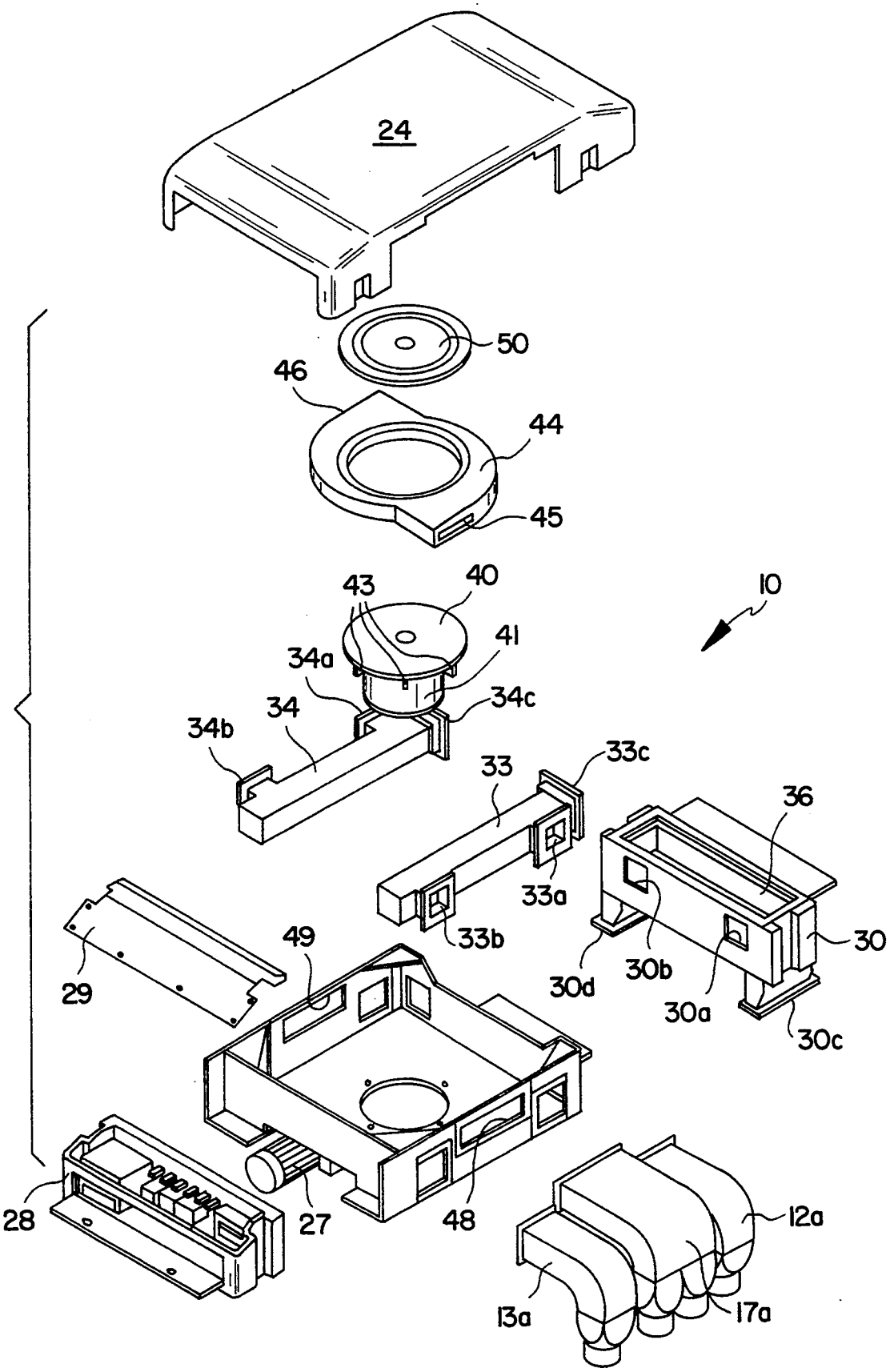
FIG. 2 is a fragmentary exploded view of the traveling textile cleaner shown in FIG. 1.

The traveling textile cleaner 10 components are shown in more detail in FIG. 2. Chassis 23 is moved along the rail 10 by a drive motor 27. A control panel 28, which houses the electrical and electronic control components, is mounted on one end of the chassis 23, and covered by a control panel cover 29. A waste canister 30 is mounted on the other end of chassis 23.

Waste is fed from the vacuum ducts **12*a*–14*a* through respective waste ducts 33, 34 which are mounted on the chassis and which include waste duct inlets 33*a*,33*b* and 34*a*,34*b*, respectively. Waste is exhausted from the waste ducts 33, 34 through respective waste duct outlets 33*c*, 34*c*, which mate with respective waste canister inlets 30*a*, 30*b* in the inboard side of the waste canister 30. A wire mesh filter screen 36 in the waste canister 30 divides the waste canister 30 into upstream and downstream portions. Waste is collected on the upstream side of the filter screen 36 to form an overlying layer of particulate matter, while air in which the waste was entrained passes through the filter screen 36 from the upstream to the downstream side and continues out of the waste canister 30** through its top opening.

Air exiting the waste canister 30 is pressurized by fan 40, which is powered by a five (5) horsepower, three phase, 2 pole alternating current motor 41 operating at 3,600 rpm (nominal). Of course, different types and sizes of motors may be used based upon consideration of the usual operating criteria.

The fan 40 is a flat, disc-type fan which has a plurality of integrally-formed vanes 43 which project downwardly into the airstream. The fan 40 is cast of aluminum and is dynamically balanced to reduce vibration and noise, and to decrease stress on the motor 41.

The fan 40 is surrounded by a blower scroll 44 which fits over and around the fan 40. As the air is moved by the fan centrifugally outwardly, the shape of the blower scroll 44 permits a smooth, efficient acceleration and outward movement of the air without undue turbulence. Air exits the blower scroll 44 through outlets 45 and 46. Outlets 45 and 46 mate with the blower ducts **17*a*,19*a*, respectively through ports 48, 49 in the opposite sides of chassis 23**.

A fan cover 50 fits onto the top of the blower scroll 44 and encloses the top of the fan 40 and blower scroll 44.

Figure 4:
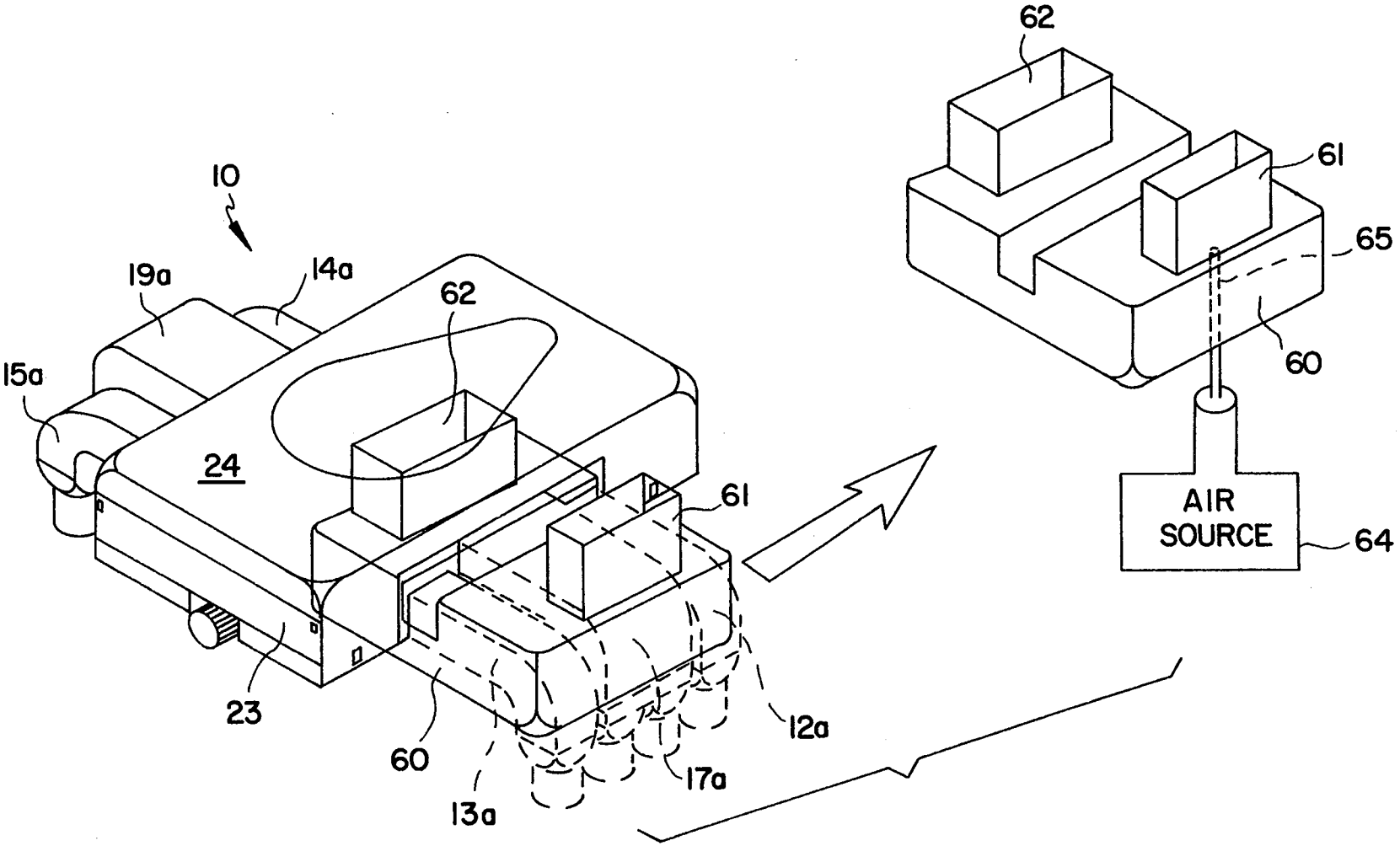
FIG. 4 is a fragmentary perspective view of the traveling textile cleaner moving into position for emptying the waste canister at the unloading station.
Figure 5:
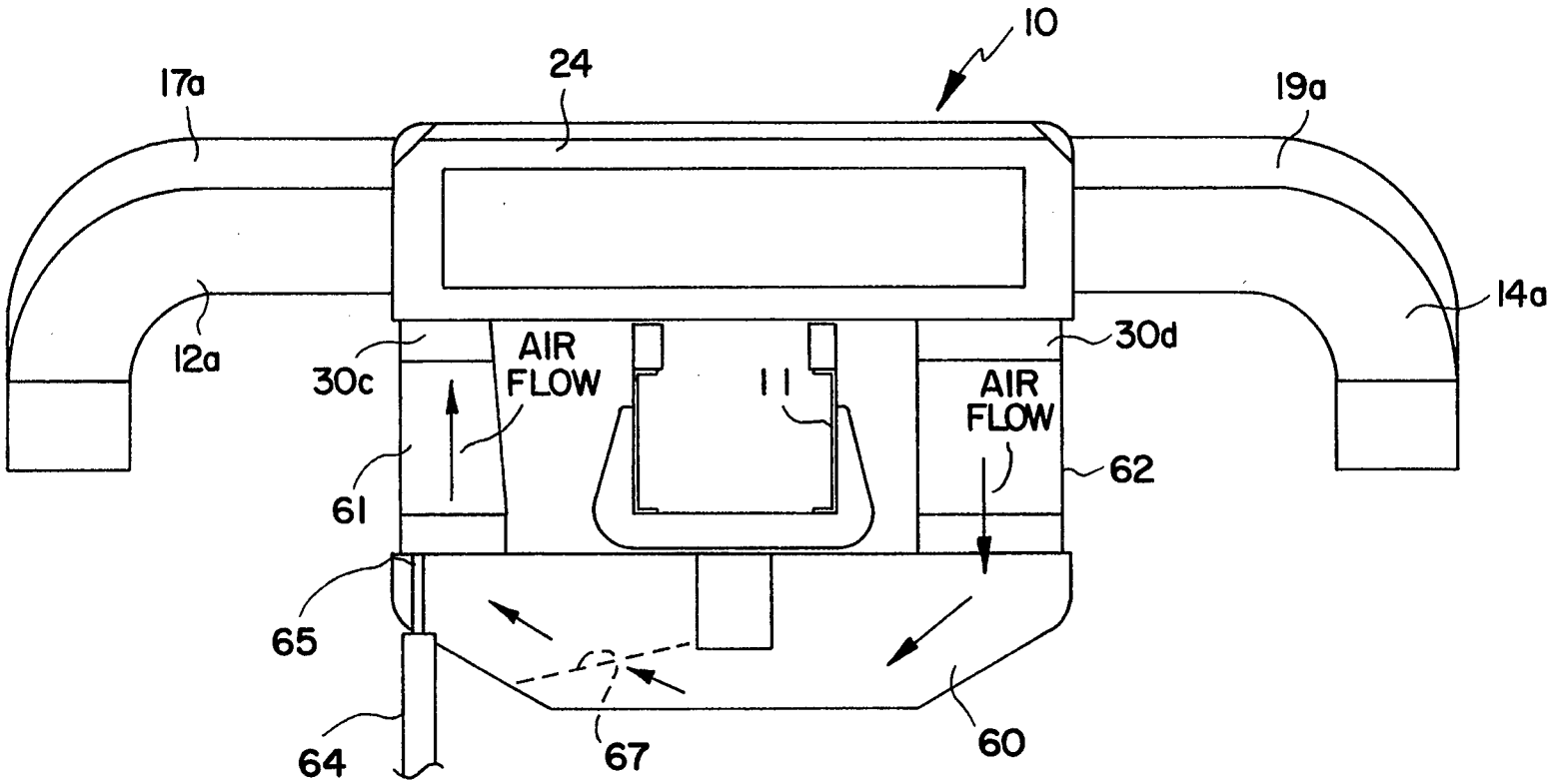
FIG. 5 is a cross-sectional view of the traveling textile cleaner in position for emptying the waste canister at the unloading station.

As is shown in FIG. 4, the traveling textile cleaner 10 periodically moves into position to dock at an unloading station 60. The unloading station 60 includes a blower duct 61 and a vacuum duct 62. The blower duct 61 mates with an unloading air inlet **30*c* in the bottom of waste canister 30, and the vacuum duct 62 mates with a unloading waste outlet 30*d*, also in the bottom of the waste canister 30 on the opposite side of the bottom from the unloading air inlet 30*c*. Pressurized air is supplied to the blower duct 61 from a compressed air source 64 through a nozzle 65 which communicates with blower duct 61. This compressed air moves at high speed from the blower duct 61 of the unloading station 60 through the waste canister 30 and removes the waste accumulated in the canister 30. The pressure differential in blower duct 61 caused by the compressed air creates a circular air flow, as is best shown in FIG. 5, causing air flow back down from the downstream side of the waste canister 30 into the unloading station through the unloading waste duct 30*d*, carrying the waste from the waste canister 30 with it. The system is thus a closed air-flow system. Waste is trapped in the unloading station 60 on the upstream side of a screen filter 67**.

However, as explained above, as long as fan 40 is rotating, sufficient air is moving through the waste canister from the waste ducts 33 and 34 to hold the accumulated waste matter onto the downstream side of the filter screen 36, and to interfere with the effective operation of the compressed air from the unloading station 60. Cutting off the power to the motor 41 will, of course, eventually cause the motor 41 and thus the fan 40 to stop rotating. However, the fan 40 has sufficient mass that it continues to spin for as long a one minute, thus substantially increasing the amount of time it takes to empty the waste canister 30.

Figure 3:
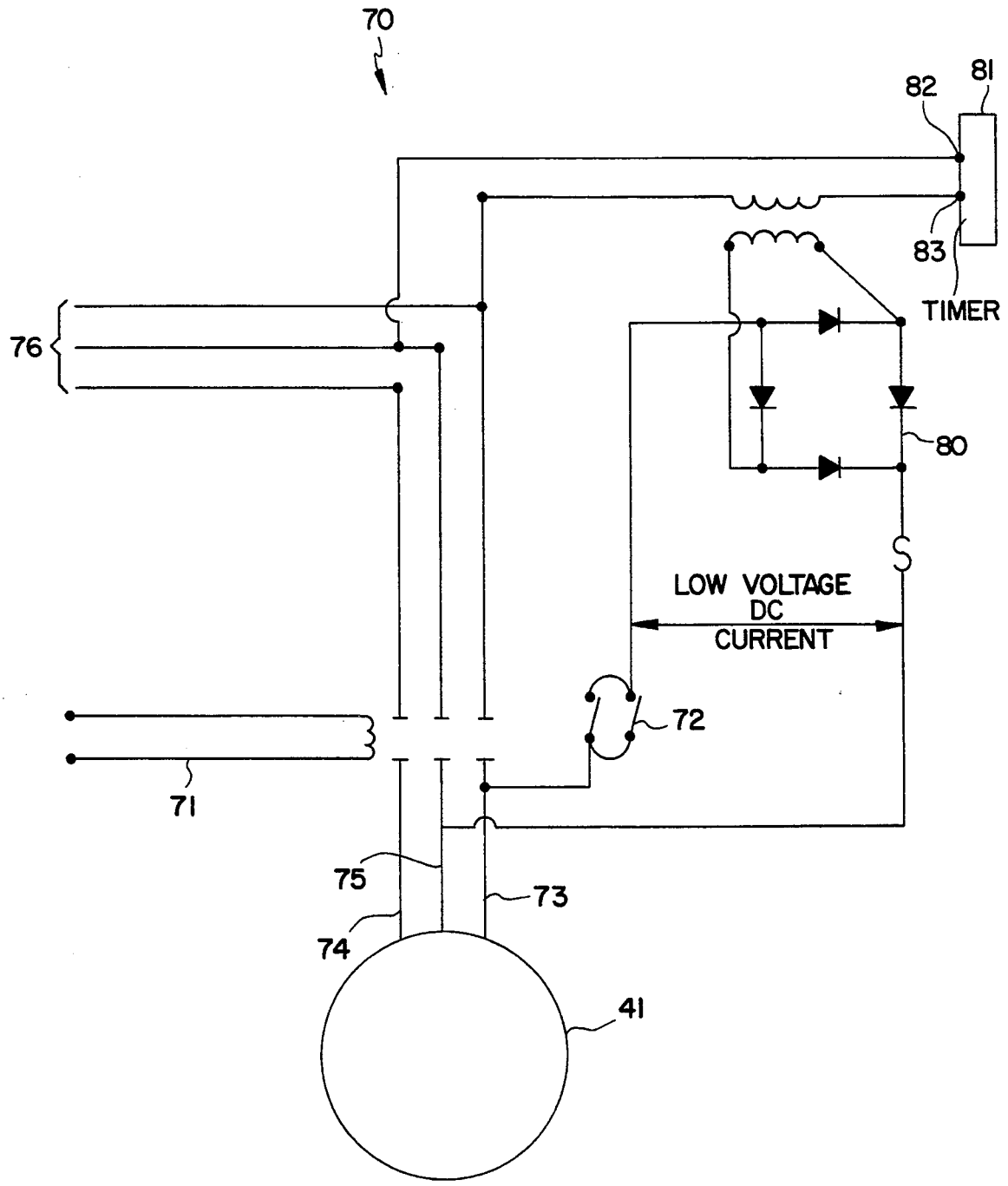
FIG. 3 is an electrical schematic of the fan brake according to an embodiment of the invention of the present application.

Therefore, a fan brake circuit 70 is provided to quickly bring the motor 41 and thus the fan 40 to a stop. As is shown in FIG. 3, as the traveling textile cleaner 10 parks over the unloading station 60, a fan motor electrical contactor 71 is turned on, and contact points 72 close, applying DC voltage from a DC circuit 80 to one of the windings 73 of the motor 41. No current, AC or DC, flows to the other windings 74 and 75.

The DC current sets up a stationary inductance in the winding 73 which reacts to retard movement of the rotor of the motor 41. It has been determined empirically that the motor 41 will cease rotation in approximately eight seconds, thus substantially increasing the efficiency of the waste unloading operation. After a set period of time, such as 10–15 seconds, a timer 81 opens the contact points 82,83, stopping the flow of DC current to the winding 73. The use of magnetic inductance to brake the fan 40 requires no moving or wear-inducing parts.

At this point, the emptying of the waste canister 30 proceeds as previously described. Upon completion of the unloading process, the fan motor electrical contactor 71 is closed, opening contact points 72 and applying three phase alternating current from a power source 76 to the motor 41, and resetting the timer 81. The traveling textile cleaner 10 resumes its cleaning operations by undocking from the unloading station 60 and resuming cleaning movement along rail 11.

A fan brake for a traveling textile cleaner is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. In a traveling, rail-mounted overhead cleaner for cleaning textile processing machines and adjacent floor areas, including a cleaner chassis, drive means for moving the cleaner along the rail, fan means for generating an air flow, conduit means cooperating with said fan means for applying the air flow to areas to be cleaned, a waste canister cooperating with said conduit means for receiving and retaining accumulated waste therein, an unloading station for unloading waste accumulated by the cleaner, and electrical circuit means for controlling the movement of the traveling cleaner around its cleaning circuit and to and from the unloading station, the improvement which comprises brake means for applying an external braking force to said fan means for bringing the fan means to a stop at a rapid rate whereby unloading of the accumulated waste from the cleaner to the unloading station can begin.

2. In a traveling cleaner according to claim 1, wherein said fan means comprises an alternating current fan motor, and a fan rotatably-mounted on said fan motor, and said brake means includes electrical contactor means for removing alternating current from said fan motor windings.

3. In a traveling cleaner according to claim 2, wherein said brake means includes timing means for removing the direct current voltage from the fan motor winding after a predetermined time.

4. In a traveling cleaner according to claim 2 or 3, wherein said unloading station includes blower means for blowing air through the conduit means and waste canister to discharge the waste into the unloading station, and wherein said circuit means activates said blower upon removal of the direct current from the fan motor.

5. In a traveling cleaner according to claim 4, wherein said fan comprises a flat disk having fan blades formed in the axially-extending periphery thereof.

* * * * *